US005233266A

United States Patent [19]

Spina et al.

[11] Patent Number: 5,233,266

[45] Date of Patent: Aug. 3, 1993

[54] COLOR PICTURE TUBE HAVING IMPROVED SHADOW MASK-FRAME ASSEMBLY SUPPORT

[75] Inventors: Paolo Spina; Pedro E. Cosma, both of Rome, Italy

[73] Assignee: Videocolor, S.p.A., Anagni, Italy

[21] Appl. No.: 829,108

[22] Filed: Jan. 31, 1992

[51] Int. Cl.[5] ..... H01J 29/07

[52] U.S. Cl. ..... 313/402; 313/404

[58] Field of Search ..... 313/402, 404, 406

[56] References Cited

U.S. PATENT DOCUMENTS

| | | | |
|---|---|---|---|
| B. 523,696 | 1/1976 | Groot | 313/404 |
| 3,573,527 | 4/1971 | Hafkenscheid et al. | 313/85 |
| 3,890,526 | 6/1975 | Palac | 313/404 X |
| 4,613,785 | 11/1986 | Ragland, Jr. | 313/405 |
| 4,723,088 | 2/1988 | Sone et al. | 313/404 |
| 4,728,853 | 3/1988 | Sone et al. | 313/406 |
| 4,884,005 | 11/1989 | Kornaker et al. | 313/404 |

*Primary Examiner*—Sandra L. O'Shea

*Attorney, Agent, or Firm*—Joseph S. Tripoli; Dennis H. Irlbeck

[57] ABSTRACT

The improved color picture tube includes an evacuated glass envelope having a rectangular faceplate panel. The panel includes a shadow mask assembly mounted therein by support means located at the four corner of the panel. Each support means includes a stud attached to the glass envelope. The improvement comprises the support means also including, at each of the four corners, a first spring and a second spring. Each spring is elongated, with a first portion thereof attached to the mask assembly and a second portion thereof cantilevered away from the assembly. The first spring extends peripherally in a first direction with respect to the assembly, and the second spring extends peripherally in a second direction with respect to the assembly. The first spring includes an aperture within the second portion that engages a respective stud. A section of the second portion of the second spring overlaps the second portion of the first spring. The overlapped portions of the first and second springs are attached together.

4 Claims, 4 Drawing Sheets

COLOR PICTURE TUBE HAVING IMPROVED SHADOW MASK-FRAME ASSEMBLY SUPPORT

This invention relates to color picture tubes of the type having a shadow mask attached to a peripheral frame which is suspended in relation to a cathodoluminescent screen and, particularly, to improved means for suspending a mask-frame assembly in such a tube.

BACKGROUND OF THE INVENTION

In most current color picture tube types, a peripheral frame supporting a shadow mask is suspended in a faceplate panel by means of springs that are welded either directly to the frame or to plates which in turn are welded to the frame. In the directly welded version, the springs are usually made of bimetallic materials; and in the plate version, the plates are bimetallic. As the springs or plates become heated by transfer of heat from the mask through the frame, the bimetallic materials expand differently, thereby bending the springs or plates to cause movement of the mask-frame assembly toward a screen disposed on the panel. It is also known to use the geometric structure of the springs to cause this same motion towards the screen by action of the force of the expanding mask-frame assembly against the springs.

It is common to use either three of four springs to support a mask-frame assembly within a rectangular faceplate panel of a tube. In a three-spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the mask-frame assembly to twist slightly and shift relative to the faceplate, during tube manufacture and/or operation.

A known means for minimizing twisting and shifting of a mask-frame assembly uses spring supports at the four corners of the frame. Embodiments for achieving such corner support are shown in U.S. Pat. No. 4,723,088, issued to Sone et al. on Feb. 2, 1988, in U.S. Pat. No. 4,728,853, issued to Sone et al. on Mar. 1, 1988, and in U.S. Pat. No. 4,884,005, issued to Kornaker et al. on Nov. 28, 1989. Use of a four-spring corner support system has another advantage. With a corner support system, a lighter frame can be used. This results not only in a cost reduction, but also yields better performance for mask-doming and long-term temperature compensation in a completed tube.

U.S. Pat. No. 4,723,088 shows a mask frame having truncated corners with supports at each corner. The supports are bent plates including three sections. A first section is welded to the frame. A second section extends at an angle from the first section toward a skirt of a faceplate panel. A third section extends from the second section and includes an aperture that engages a metal stud embedded in the panel sidewall.

U.S. Pat. NO. 4,728,853 discloses a mask-frame assembly support which includes two members welded together. One member, having a flat plate shape, is welded to a mask frame. The second member includes three sections. A first section is welded to the first member. A second section angles from the first section, and an apertured third section engages a support stud in the panel sidewall.

U.S. Pat. No. 4,884,005 shows a mask without a frame. Auxiliary brackets are used to reinforce the corners of the mask and, at each corner, a spring is attached to a bimetal element which, in turn, is attached to a bracket some distance from the corner of the tube. The free ends of the springs extend into the corners where they rest on spherical ends of studs. The ends of the retaining springs are bent so as to be perpendicular to the longitudinal axis of the studs.

A problem encountered with many prior art support systems is that they may shift when subjected to shock and vibration. Therefore, there is a need for improvements in mask support systems that will reduce their susceptibility to such shifts. The present invention provides an improvement in tubes, making them less affected by shock and vibration than are encountered in tubes with the prior art support systems.

SUMMARY OF THE INVENTION

The improved color picture tube, according to the invention, includes an evacuated glass envelope having a rectangular faceplate panel. The panel includes a shadow mask assembly mounted therein by support means located at the four corners the panel. The support means at each of the corners includes a stud attached to the glass envelope. The improvement comprises the support means also including, at each of the four corners, a first spring and a second spring. Each spring is elongated, with a first portion of each spring attached to the shadow mask assembly and a second portion of each spring cantilevered away from the assembly. The first spring extends peripherally in a first direction with respect to the assembly, and the second spring extends peripherally in a second direction with respect to the assembly. The first spring includes an aperture within the second portion that engages a respective stud. A portion of the second portion of the second spring overlaps the second portion of the first spring. The overlapped portions of the first and second springs are attached together.

DETAILED DESCRIPTION OF THE PREFERRED EMBODIMENTS

Figure 1:
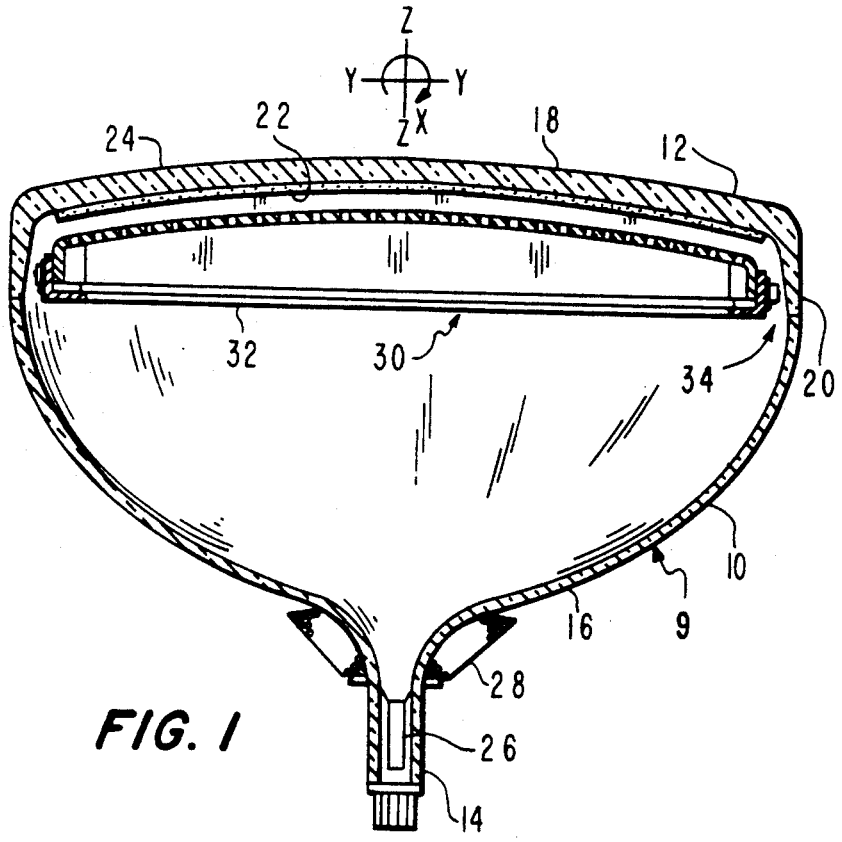
FIG. 1 is an axially sectioned side view of a color picture tube embodying the present invention.

FIG. 1 shows a rectangular color picture tube 9 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X, parallel to its wider dimension (usually horizontal), and a minor axis Y, parallel to its narrower dimension (usually vertical). The major and minor axes are perpendicular to the central longitudinal axis Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y. Alternatively, the screen may be a dot screen. A multiapertured color selection electrode or shadow mask 24 is removably mounted, by improved means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 28, located in the vicinity of the funnel-to-neck junction. When activated, the yoke 28 subjects the three beams to magnetic fields which cause the beams to scan horizontally and vertically in a rectangular raster over the screen 22.

Figure 2:
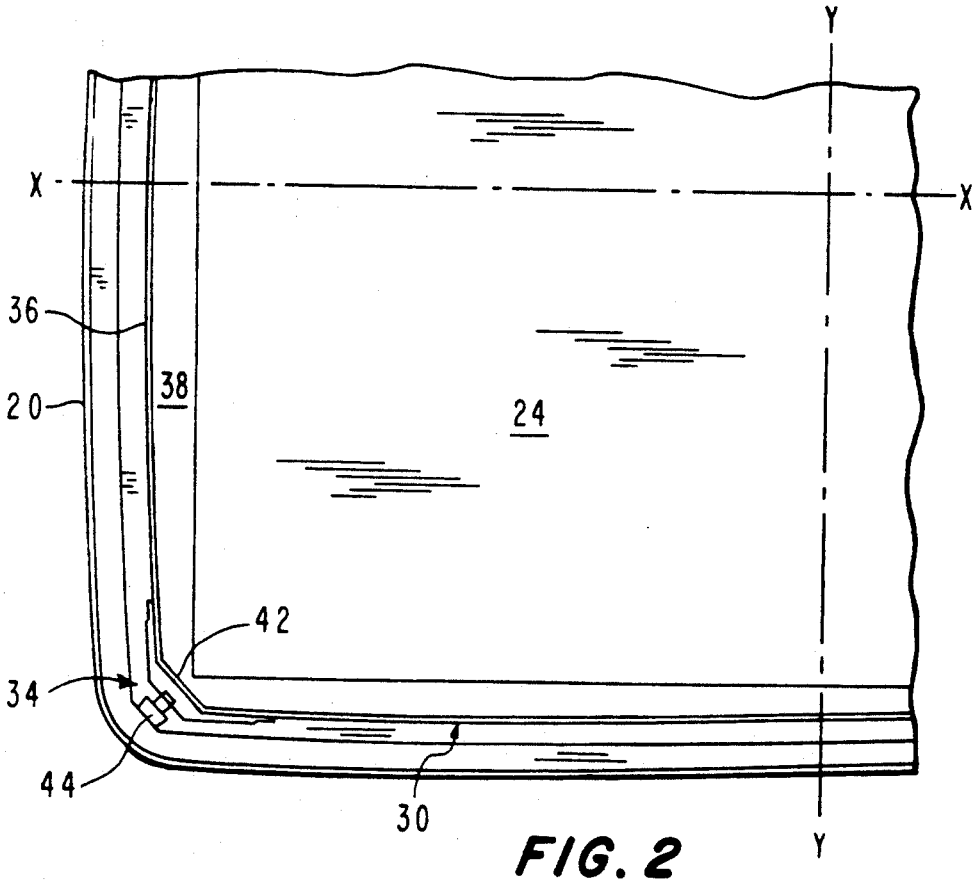
FIG. 2 is a bottom view of a quadrant of the faceplate panel and mask-frame assembly of the tube of FIG. 1.

The shadow mask 24 is part of a mask-frame assembly 30 that also includes a peripheral frame 32. The mask-frame assembly 30 is shown positioned within the faceplate panel 12 in FIGS. 1 and 2. The mask-frame assembly 30 is mounted to the panel 12 by four improved support means 34, shown in FIGS. 2 and 3.

The frame 32 has two long sides and two short sides and includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z of the tube 9. The four corners 42 of the frame 32 are truncated, being angled approximately perpendicularly to the diagonal directions of the frame.

The shadow mask 24 includes a curved apertured portion, an imperforate border portion surrounding the apertured portion, and a skirt portion bent back from the border portion and extending away from the screen 22. The mask 24 is telescoped within or set inside the frame 32 and welded to the inside surface of the first flange 36.

Figure 3:
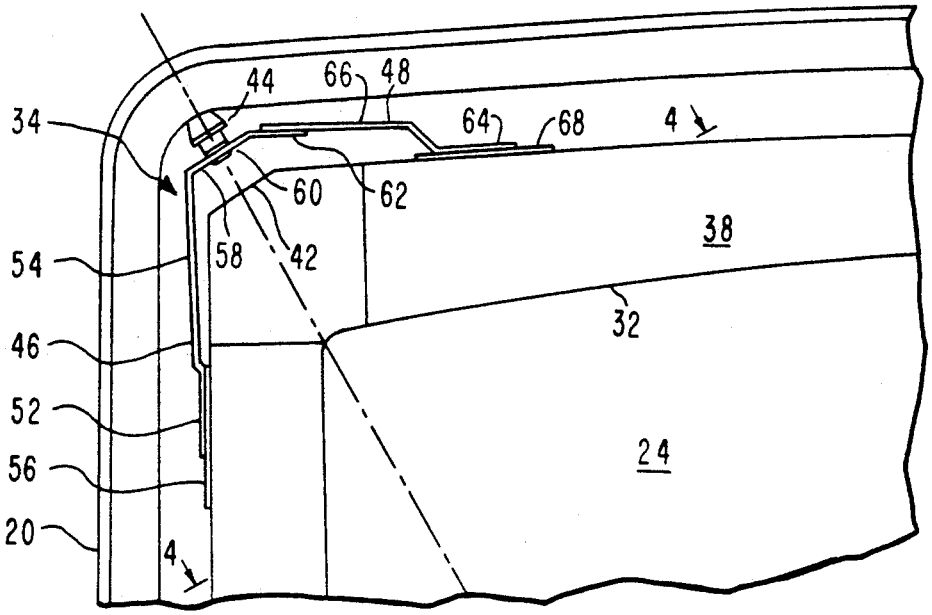
FIG. 3 is an enlarged view of a corner of the faceplate panel of FIG. 2.
Figure 4:
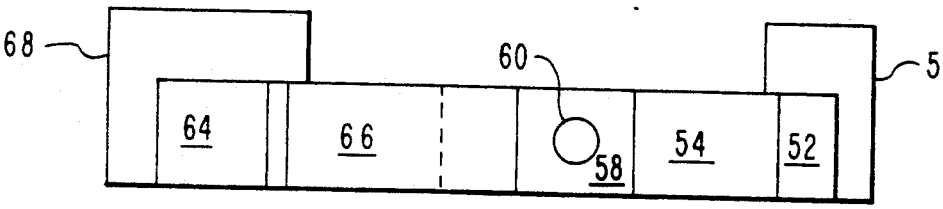
FIG. 4 is a side view of corner support springs taken at line 4—4 of FIG. 3.
Figure 5:
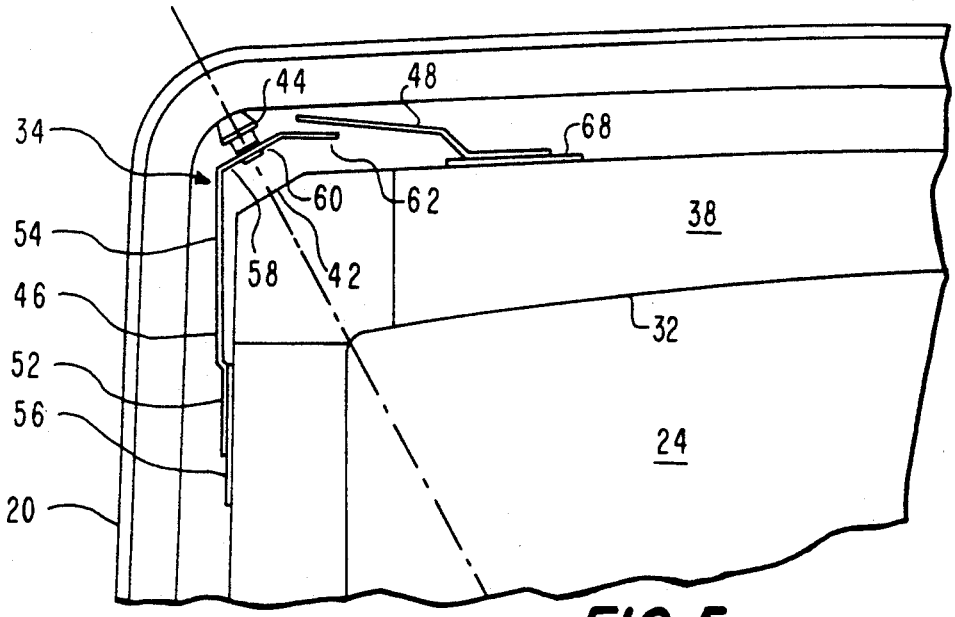
FIG. 5 is an enlarged view of the same corner of the faceplate panel, as in FIG. 3, during construction of the tube.

Mask-frame assembly support means 34 are included at each of the four corners of the frame and panel. As shown in FIGS. 3 to 5, each support means 34 includes a stud 44 and two elongated springs, a first spring 46 and a second spring 48. Each stud 44 is a conically-shaped metal member that is attached to the panel sidewall 20. The spring 46 includes two portions 52 and 54. The first portion 52 may be attached directly to the first flange 36 of the frame 32, or, as shown in FIG. 3, to a bimetallic plate 56 which in turn is attached to the first flange 36 of the frame 32. The second portion 54 extends peripherally from the first portion 52 and is cantilevered away from the frame, toward a corner of the panel. The second portion 54 includes an intermediate section 58 that is bent to substantially parallel a truncated corner 42 of the frame 32 and to be perpendicular to the stud 44. The intermediate section 58 includes an aperture 60 therein that engages a respective stud 44. An end section 62 of the second portion 54 extends from the intermediate section 58 and is bent to substantially parallel a side of the frame that is adjacent to the side of the frame to which the first portion 52 is attached.

The second spring 48 includes two portions, a first portion 64 and second portion 66. The first portion 64 of the spring 48 is attached to the side of the frame 32 that is adjacent to the side of the frame to which the first spring is attached. This attachment may be made directly to the first flange 36, or, as shown in FIG. 3, to a bimetallic plate 68, which in turn is attached to the first flange 36. The second portion 66 extends peripherally from the first portion 64 toward a corner of the panel and overlaps the end section 62 of the second portion 54 of the first spring 46. The overlapped portions of the first and second springs are attached, such as by welding, riveting or clipping together.

The bimetallic plates 56 and 68, sometimes are referred to as clips, are of laminated bimetallic construction. One metal layer, facing the frame, is a high thermal expansion material, and the other metal layer, facing the spring, is a low thermal expansion material. Although the described support means embodiment utilizes bimetal plates between the springs and the frame, which are used to move the shadow mask closer the screen for temperature compensation, temperature compensation can also be obtained by forming all of the springs from bimetal materials.

During formation of the screen of the color picture tube 9, the mask-frame assembly must be inserted and removed from the faceplate panel 12 several times. To facilitate this insertion and removal, the second springs 48 are not attached to the first springs 46 until after the screen formation has been completed. FIG. 5 shows how the springs appear during the screen formation processes. In a preferred embodiment for a tube having a 16×9 aspect ratio and a 34 inch (86 cm) rectangular viewing screen diagonal, 0.03937 inch (0.1 cm) thick springs of Carpenter custom 455 stainless steel are used in combination with 0.03937 inch (0.1 cm) thick bimetal plates. Other preferred dimensions of the components of the support means 34 are given in Table I.

TABLE I

| | | |
|---|---|---|
| Length of spring 46 extended | 4.0319 inches | (10.241 cm) |
| Length of first portion 52 | 0.8035 inch | (2.041 cm) |
| Length of second portion 54 | 1.8256 inches | (4.637 cm) |
| Length of intermediate section 58 | 0.6752 inch | (1.715 cm) |
| Length of end section 62 | 0.5803 inch | (1.474 cm) |
| Length of spring 48 extended | 2.7650 inches | (7.023 cm) |
| Length of first portion 64 | 0.8035 inch | (2.041 cm) |
| Length of second portion 66 | 1.5299 inches | (3.886 cm) |

Computer simulated shock tests were performed on three tubes having 34 inch (86 cm) rectangular screen diagonals. Tube #1 included support means that were designed similarly, although not identically, to the support means shown in the above-identified U.S. Pat. Nos. 4,723,088 and 4,728,853. Tube #2 included support means that were designed similarly, although not identically, to the support means shown in the above-identified U.S. Pat. No. 4,884,005. Tube #3 includes support means as described above with respect to the present invention. The displacement results, in mm, for various locations on the mask and frame, in a lateral X direction and a longitudinal Z direction, to a given 30 G shock are presented in Table II.

TABLE II

| | Tube #1 | | Tube #2 | | Tube #3 | |
|---|---|---|---|---|---|---|
| | X disp | Z disp | X disp | Z disp | X disp | Z disp |
| Center of mask | 1.70 | 1.30 | 0.57 | 0 | 0.16 | 0 |
| Frame major axis | 2.00 | 2.50 | 0.65 | 0.25 | 0.24 | 0.40 |
| Frame minor axis | 1.80 | 1.40 | 0.53 | 0 | 0.15 | 0 |
| Frame diagonal | 1.90 | 2.20 | 0.54 | 0.02 | 0.16 | 0.05 |

Figure 6:
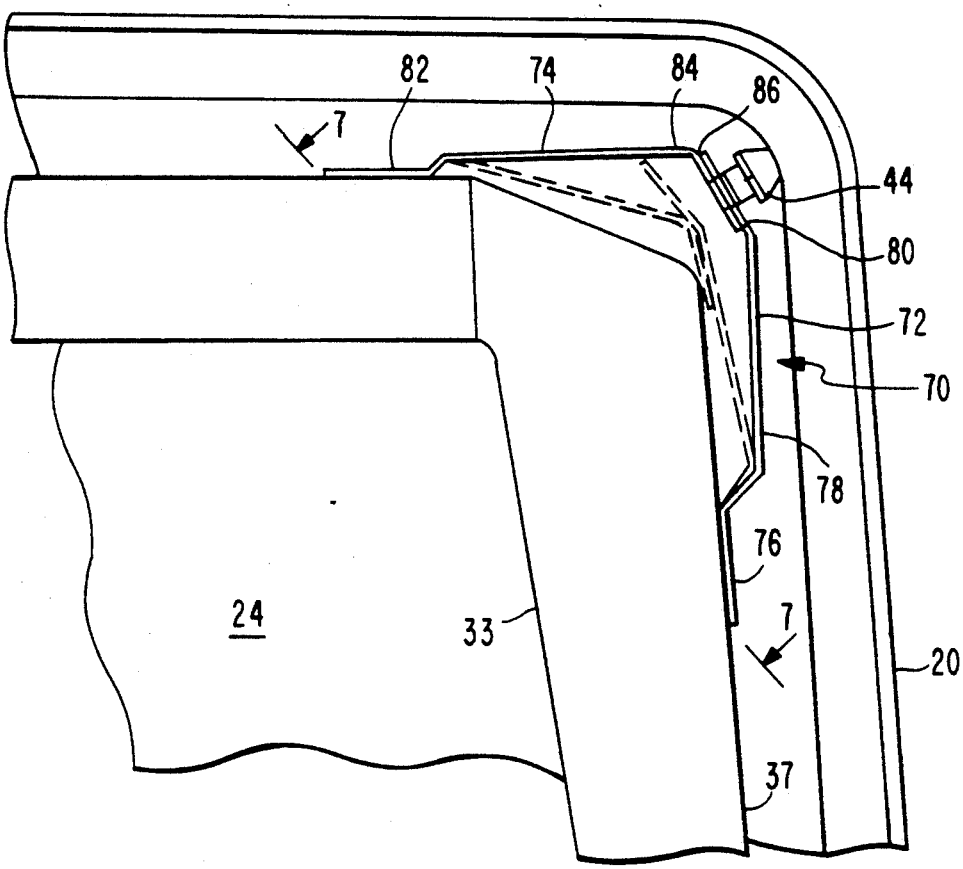
FIG. 6 is an enlarged view of a corner of a faceplate including a second embodiment of the present invention.
Figure 7:
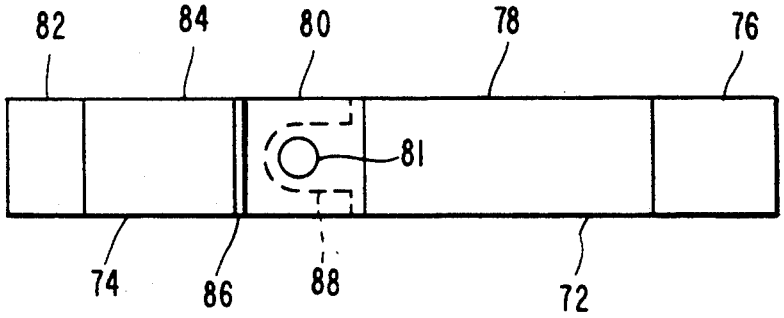
FIG. 7 is a side view of a corner support spring taken at line 7—7 of FIG. 6.

FIGS. 6 and 7 show a second support means 70 embodiment. Numbering of components that are similar to the components of the previous embodiment is repeated. Each support means 70 includes a stud 44 and two elongated springs, a first spring 72 and a second spring 74. The first spring 72 includes two portions, a first portion 76 and a second portion 78. The first portion 76 may be attached directly to a first flange 37 of a frame 33, as shown in FIG. 6, or attached to a bimettalic plate which in turn is attached to the first flange 37 of the frame 33. The second portion 78 extends peripherally from the first portion 76 and is cantilevered away from the frame, toward a corner of the panel. The second portion 78 includes an end section 80 that is bent to be substantially perpendicular to the stud 44. The end section 80 includes an aperture 81 therein which engages the stud 44.

The second spring 74 includes two portions, a first portion 82 and a second portion 84. The first portion 82 may be attached directly to the first flange 37 of the frame 33, as shown in FIG. 6, or attached to a bimettalic plate which in turn is attached to the first flange 37 of the frame 33. The second portion 84 extends peripherally from the first portion 82 and is cantilevered away from the frame, toward a corner of the panel. The second portion 84 includes an end section 86 that is bent to be substantially perpendicular to the stud 44 and to overlap the end section 80 of the second portion 78 of the first spring 72. The end section 86 includes a slot 88 therein that is open at the end of the spring. The slot 88 in the second spring 74 is of sufficient size not to interfere with the stud 44. The overlapped portions of the first and second springs are attached, such as by welding, riveting or clipping together.

The angles of the truncated corners on the frame 33 of the second support means 70 are different than the angles of the corners of the frame 32 of the first support means 34. In the first support means 34, the corners of the frame 32 are substantially perpendicular to the central axes of the studs 44. However, in the second support means 70, the corners are angled to accommodate the springs 72 and 74 in their retracted positions, prior to welding, as shown in dashed lines in FIG. 6.

Figure 8:
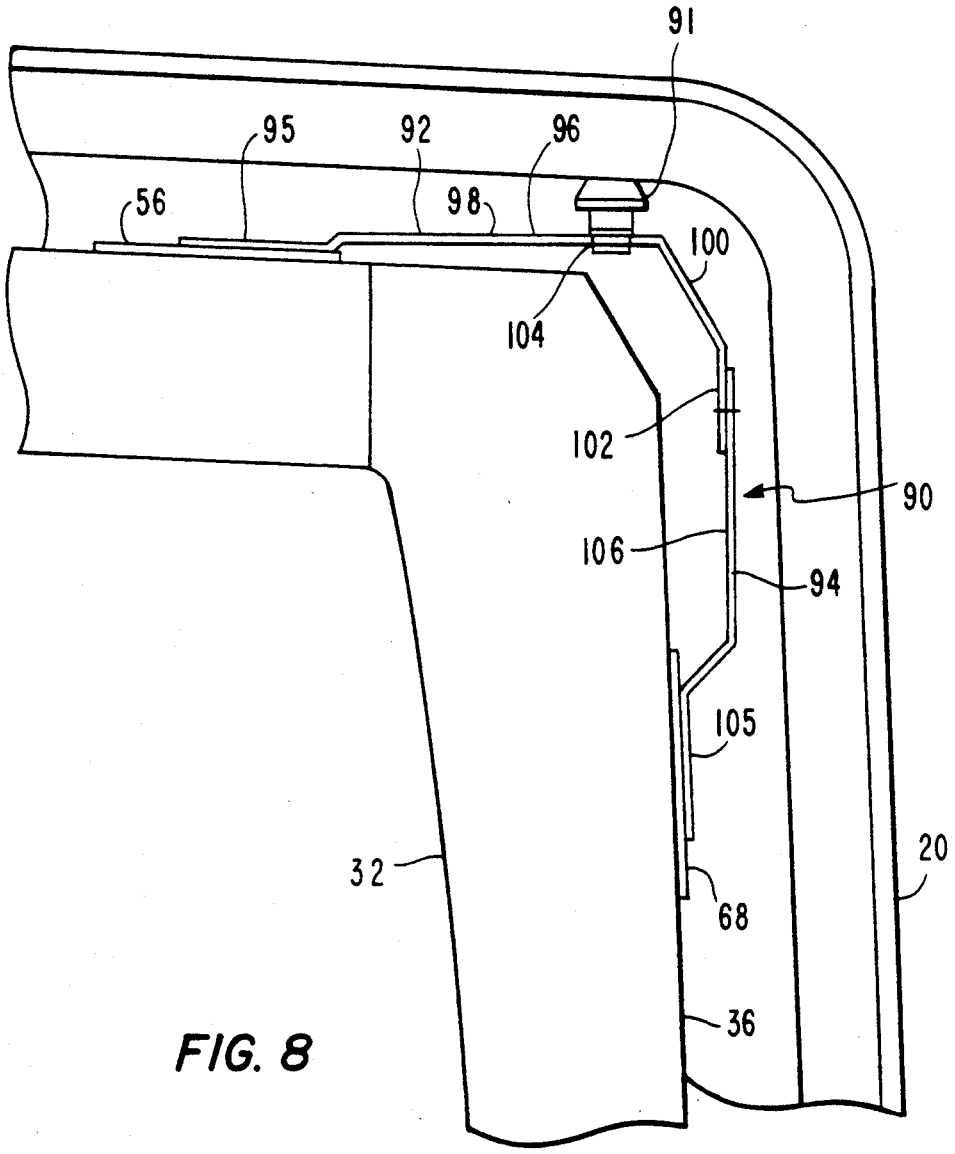
FIG. 8 is an enlarged view of a corner of a faceplate including a third embodiment of the present invention.

A third support means 90 embodiment is shown in FIG. 8. Again, numbering of components that are similar to the components in previous embodiments is repeated. In this third embodiment, each support means 90 includes a stud 91 and two elongated springs, a first spring 92 and a second spring 94. The first spring 92 includes two portions, a first portion 95, and a second portion 96. The first portion 95 may be attached directly to the first flange 36 of the frame 32, or, as shown in FIG. 8, to a bimetallic plate 56 which in turn is attached to the first flange 36 of the frame 32. The second portion 96 extends peripherally from the first portion 95 and is cantilevered away from the frame, toward a corner of the panel. The second portion 96 includes three sections, a first section 98 adjacent to the first portion 95, an intermediate section 100, that is bent to substantially parallel to truncated corner 42 of the frame 32, and an end section 102. The first section 98 includes an aperture 104 therein that engages a respective stud 91. In this embodiment, the stud 91 in not positioned at a corner but rather is positioned along a side near a corner. The end section 102 of the second portion 96 extends from the intermediate section 100 and is bent to substantially parallel a side of the frame that is adjacent to the side of the frame to which the first portion 95 is attached.

The second spring 94 includes two portions, a first portion 105 and a second portion 106. The first portion 105 of the spring 94 is attached to the side of the frame 32 that is adjacent to the side of the frame to which the first spring is attached. This attachment may be made directly to the first flange 36, or, as shown in FIG. 8, to a bimettalic plate 68, which in turn is attached to the first flange 36. The second portion 106 extends peripherally from the first portion 105 toward a corner of the panel and overlaps the end section 102 of the second portion 96 of the first spring 92. The overlapped portions of the first and second springs are attached, such as by welding, riveting or clipping together.

What is claimed is:

1. In a color picture tube including an evacuated glass envelope having a rectangular faceplate panel, said panel including a shadow mask assembly mounted therein by support means located at the four corners said panel, and said support means at each of said corners including a stud attached to said glass envelope, the improvement comprising said support means also including at each of said corners a first spring and a second spring, each spring being elongated, with a first portion thereof attached to said shadow mask assembly and a second portion thereof cantilevered away from said assembly, said first spring extending peripherally in a first direction with respect to said assembly and said second spring extending peripherally in a second direction with respect to said assembly, said first spring including an aperture within said second portion engaging a respective stud, a section of the second portion of said second spring overlapping a section of the second portion of said first spring, and the overlapped sections of said first and second springs being attached together.

2. The color picture tube of claim 1, wherein said shadow mask assembly includes a shadow mask attached to a peripheral frame having two long sides, two short sides and four corners, and including said first portion of each spring in said support means being attached to one of said sides of said frame and said second portion thereof being cantilevered away from said frame, said second portion of said first spring including an intermediate section bent to be substantially perpendicular to said stud, and an end section that is bent to substantially parallel a side of the frame which is adjacent to the side of the frame to which the first spring is attached, and said aperture being included within the intermediate section of said second portion.

3. The color picture tube of claim 1, wherein said shadow mask assembly includes a shadow mask attached to a peripheral frame having two long sides, two short sides and four corners, and including said first portion of each spring in said support means being attached to one of said sides of said frame and said second portion thereof being cantilevered away from said frame, said second portion of each spring including an end section bent to be substantially perpendicular to said stud, and said aperture being included within the end section of said second portion of one of said springs and the other of said springs including a slot therein at the location of said stub.

4. The color picture tube of claim 1, wherein said shadow mask assembly includes a shadow mask attached to a peripheral frame having two long sides, two short sides and four corners, and including said first portion of each spring in said support means being attached to one of said sides of said frame and said second portion thereof being cantilevered away from said frame, said second portion of said first spring including a first section, an intermediate section, and an end section that is bent to substantially parallel a side of the frame which is adjacent to the side of the frame to which the first spring is attached, said aperture being included within the first section of said second portion and said stub being located along a side of said panel near a corner of said panel.

* * * * *